United States Patent [19]

Hedrick

[11] Patent Number: 4,747,341

[45] Date of Patent: May 31, 1988

[54] INTEGRAL GRID STRUCTURE FOR PROVIDING NEGATIVE PRESSURE PLENUM

[75] Inventor: Geoffrey S. Hedrick, Malvern, Pa.

[73] Assignee: Donaldson Company, Inc., Minneapolis, Minn.

[21] Appl. No.: 932,731

[22] Filed: Nov. 19, 1986

[51] Int. Cl.[4] ..... F24F 3/16

[52] U.S. Cl. ..... 98/31.5; 98/36; 98/40.1

[58] Field of Search ..... 98/31.5, 31.6, 36, 40.1; 55/385 A, 502

[56] References Cited

U.S. PATENT DOCUMENTS

| | | | |
|---|---|---|---|
| 3,880,625 | 4/1975 | Shook | 98/40.1 |
| 4,344,784 | 8/1982 | Deckas et al. | 98/40.1 |
| 4,371,386 | 2/1983 | DeVecchi | 55/502 |
| 4,549,472 | 10/1985 | Endo et al. | 55/385 A |
| 4,600,419 | 7/1986 | Mattison | 55/502 |
| 4,601,737 | 7/1986 | Gerbig | 55/502 |
| 4,608,066 | 8/1986 | Cadwell | 55/385 A |
| 4,634,527 | 1/1987 | Marshall | 55/502 |

*Primary Examiner*—Larry I. Schwartz

*Attorney, Agent, or Firm*—Merchant, Gould, Smith, Edell, Welter & Schmidt

[57] ABSTRACT

A system for providing an airtight/particle tight hermetically sealed clean room environment (20) from which air is passed through a filter (22) includes a panel supporting grid member (24, 24*a*) having a negative pressure return (32) integrally formed therein for preventing air leakage into the clean room environment (20) with the grid member (24) comprising a circumferential mounting frame having an aperture therein, and a filter panel (22) which is mounted in the frame (24, 24*a*) in hermetically sealing engagement therewith for closing the aperture. The mounted filter panel (22) and the integral grid member (24, 24*a*) comprises a negative pressure plenum cavity (32) with the grid member (24, 24*a*) per se comprising a plenum member which allows negative pressure to be carried around the mounted filter panel (22).

10 Claims, 1 Drawing Sheet

FIG. 1
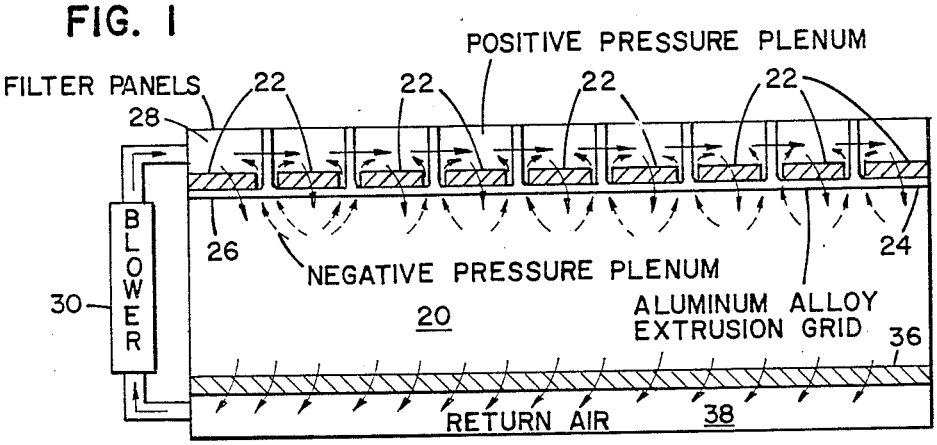
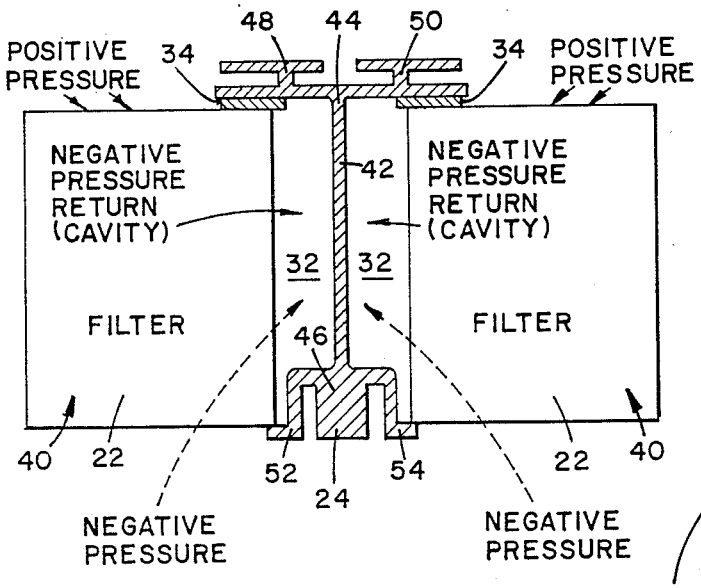
FIG. 2
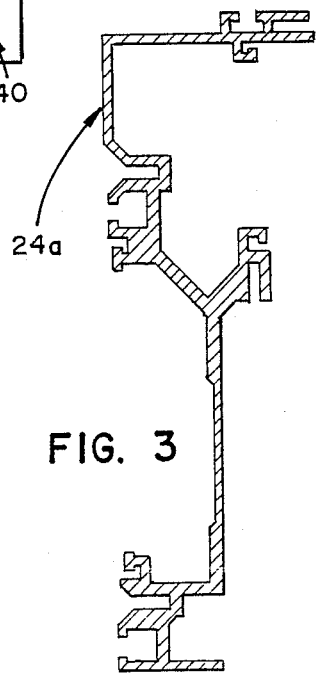
FIG. 3

INTEGRAL GRID STRUCTURE FOR PROVIDING NEGATIVE PRESSURE PLENUM

TECHNICAL FIELD

The present invention relates to systems for providing an airtight/particle-tight hermetically sealed clean room environment from which air enters through a filter, and particularly to such systems in which a panel supporting grid system, such as a ceiling grid, is employed and a negative pressure plenum is provided for preventing air leakage into the clean room environment.

BACKGROUND OF THE INVENTION

Clean room environments in which ceiling grids containing filter panels are employed are well known in the art. Such systems generally employ dropped ceilings above which is a positive pressure plenum from which air passes through the filter panels in the ceiling grid into the clean room. Normally, in a clean room environment, it is imperative to achieve a hermetic seal for the filter panels in the ceiling grid since the particulate count in the room must normally be maintained at 10 particulates per cubic foot or less even though the air above the plenum often contains as many as 100,000 particulates, even under ideal conditions. In an attempt to provide such a hermetic seal so that no air can leak around the filter panels where they contact the supporting ceiling grid, prior art techniques have employed the mounting of filter panels in troughs filled with a vaseline like substance in an effort to provide a hermetic type seal while allowing the filter panel to be readily removed for access or replaced. Such prior art systems also employ gaskets located on the filter screen for sealing the gasket cavity in the frame mounted position of the filter panel. If such gaskets leak, however slight, or the seal is not perfect, this can totally destroy the ability of the clean room environment to maintain the desired 10 particulates per cubic foot particulate count. In an event to compensate for such potential problems, negative pressure plenums have been employed to prevent unfiltered air from entering the clean room environment should a leak occur in the filter housing, such as offered by the LS Series Type 2 laminar flow work stations commercially available from Integrated Air Systems Inc., the assignee herein. However, such a system is a suspended module and, although satisfactory from a leakage point of view, it is not readily adaptable to a suspended grid type of dropped ceiling created clean room environment. In such an environment, it is desirable not only to create a negative pressure plenum, but to do it with the least number of components, with minimal installations time, and with as modular a system as possible to readily accomodate for variations in the size of the rooms which are being converted to clean rooms. To applicant's knowledge no such satisfactory system exists in the prior art. These disadvantages of the prior art are overcome by the present invention.

DISCLOSURE OF THE INVENTION

A system for providing an airtight/particle tight hermetically sealed clean room environment from which air is passed through a filter includes a panel supporting grid member having a negative pressure return integrally formed therein for preventing air leakage into the clean room environment. The grid member comprises a circumferential mounting frame and has an aperture therein, with the frame mounting the filter panel therein in hermetically sealing engagement therewith for closing the aperture. The mounted filter panel comprises a filter screen, to which a gasket is bonded to seal the negative pressure cavity, with the filter screen being disposable across the aperture for filtering the exhausted air therethrough. The integral grid member, which is preferably an aluminum alloy extrusion, such as a T-bar extrusion, together with the mounted filter panel, comprise a negative pressure plenum cavity, with the integral grid member per se comprising a plenum member which allows negative pressure to be carried around the mounted filter panel. The negative pressure cavity which is created in the integral grid is, therefore, formed without the need for separate caps or a clamp mechanism, for example, thereby facilitating the cost and ease of installation.

BRIEF DESCRIPTION OF THE DRAWINGS

FIG. 1 is a diagrammatic illustration of a clean room environment employing the concept of the present invention;

FIG. 2 is an enlarged fragmentary sectional view of a typical mounted filter panel in the ceiling grid of the clean room environment of FIG. 1 in accordance with the present invention, illustrating an exemplary configuration of the presently preferred T-bar extrusion for the grid member employed in the ceiling grid of the clean room environment of FIG. 1 in accordance with the present invention; and FIG. 3 is an enlarged fragmentary view of an exemplary configuration of the presently preferred side wall extrusion for the grid member employed in the ceiling grid of the clean room environment of FIG. 1 in accordance with the present invention.

BEST MODE FOR CARRYING OUT THE INVENTION

Referring now to the drawings in detail, and initially to FIG. 1, the presently preferred embodiment of the present invention is shown. As will be explained in greater detail hereinafter, FIG. 1 illustrates a gasket sealing system, having a negative pressure plenum for preventing air leakage into a clean room environment 20, in which a plurality of filter panels 22 are mounted in the presently preferred ceiling grid panel or frame 24 of a dropped ceiling 26. The filter panels 22 in conjunction with the ceiling grid 24 of the present invention provide a hermetically sealed clean room environment 20 and seal the positive pressure plenum 28 above the dropped ceiling 26 to provide a clean room by filling the presently preferred ceiling grid 24 with the filter panels 22 and positively pressurizing the plenum 28 above the dropped ceiling 26 with a conventional air blower 30. In addition, as will be described in greater detail hereinafter, the mounted filter panels 22 and the presently preferred grid 24 of the present invention combine to create a negative pressure cavity 32, without the need for any external clamps or caps, etc., in the event the sealing gasket 34 attached to the filter panel 22 leaks, thereby creating a negative pressure plenum whose air flow is illustrated by the dotted arrows in FIGS. 1 and 2, by way of example. The air blower 30 is preferably a high volume air blower designed to normally provide a positive pressure plenum 28 above the dropped ceiling 26 with respect to a given room size.

Preferably, as shown and preferred in FIG. 1, a false floor 36 is provided in the clean room environment 20 so as to provide a return air plenum 38 below the floor 36 for th passage of return air, with the blower 30 being connected in flowthrough communication between the positive pressure plenum 28 and the return air plenum 38 as illustrated in FIG. 1. The air above the positive pressure plenum 28 in a clean room environment can normally contain as many as 100,000 particulates even under ideal conditions, with the hermetic seal preferably maintaining the particulate count in the clean room environment 20 substantially at 10 particulates per cubic foot or less.

Referring now to FIG. 2, the filter panel 22 preferably contains a conventional filter screen area 40 which spans the aperture which is formed in each of the ceiling grid members 24 comprising the dropped ceiling 26. Preferably the conventional gasket seal 34, such as one formed of PVC or rubber, is adhesively bonded to the filter 22 along the periphery of the filter frame and circumferentially extends around the periphery. As shown and preferred in FIG. 2, the ceiling grid members 24, except for the side wall extrusion, **24*a* illustrated by way of example in FIG. 3, are a T-bar extrusion which contains the negative pressure cavity 32 as an integrated part thereof so that when the filter panel 22 is mounted therein, it completes the negative pressure cavity 32 which is sealed with respect to the positive pressure plenum 28 above the dropped ceiling 26 by the gasket seal 34. FIG. 2 further illustrates that the ceiling grid member 24 is comprised of a vertical extending web member 42, an upper horizontal extending cross member 44, and a lower horizontal support member 46. Two ceiling mounting members 48, 50, extend vertically from the upper horizontal extending cross member 44. FIG. 2 also discloses two oppositely disposed air filter supporting lips 52, 54 which comprise the lower horizontal support member 46 on which air filters 22 may be securely mounted. The T-bar extrusion 24 and the side wall extrusion 24*a* are preferably composed of aluminum alloy to form the integral grid member 24, 24*a*, the integral grid member per se comprising a plenum member which allows negative pressure to be carried around the mounted filter panel 22**.

Thus, by utilizing the system of the present invention, a negative pressure cavity may readily be created in the ceiling grid of a dropped ceiling of a clean room.

What is claimed is:

1. A system for providing an airtight/particle tight hermetically sealed clean room environment from which air is passed through a filter, said system comprising a ceiling grid having a plurality of panel supporting grid members, said grid members each having a negative pressure return integrally formed therein for preventing air leakage into said clean room environment and each comprising a circumferential mounting frame having an aperture therein; and a filter panel for each aperture, said frame being capable of mounting said filter panel therein in hermetically sealing engagement therewith for closing said aperture, said mounted filter panel comprising a filter screen disposable across said aperture for filtering said exhausted air therethrough, said integral grid member and said mounted filter panel comprising a negative pressure plenum cavity, and said integral grid member comprising a T-bar extrusion having a vertical extending web member, an upper horizontal extending cross member having two vertically extending ceiling mounting members, and a lower horizontal support member having oppositely disposed air filter supporting lips, said integral grid member comprising a plenum member which allows negative pressure to be carried around said mounted filter panel; whereby a negative pressure cavity is created in said grid with said mounted filter panel without requiring additional external members.

2. A system in accordance with claim 1 wherein said filter panel further comprises a gasket member bonded to said filter screen and disposed on said filter screen for sealing said negative pressure cavity in said mounted position of said filter panel.

3. A system in accordance with claim 2 wherein said integral grid member mounting frame comprises an aluminum alloy extrusion.

4. A system in accordance with claim 2 wherein said mounted filter panel and said integral grid member comprise a hermetically sealed dropped ceiling for said clean room environment for providing a pressurizable plenum above said dropped ceiling, said system further comprising means for positively pressurizing said plenum above said dropped ceiling, said gasket member sealing said negative pressure cavity from said positive pressure plenum.

5. A system in accordance with claim 4 wherein said means for positively pressurizing said plenum above said dropped ceiling comprises an air blower means.

6. A system in accordance with claim 5 wherein said integral grid member mounting frame comprises an aluminum alloy extrusion.

7. A system in accordance with claim 1 wherein said integral grid member mounting frame comprises an aluminum alloy extrusion.

8. A system in accordance with claim 1 wherein said mounted filter panel and said integral grid member comprise a hermetically sealed dropped ceiling for said clean room environment for providing a pressurizable plenum above said dropped ceiling, said system further comprising means for positively pressurizing said plenum above said dropped ceiling.

9. A system in accordance with claim 8 wherein said means for positively pressurizing said plenum above said dropped ceiling comprises an air blower means.

10. A system in accordance with claim 8 wherein said integral grid member mounting frame comprises an aluminum alloy extrusion.

* * * * *